US006341513B1

(12) United States Patent
Chen

(10) Patent No.: US 6,341,513 B1
(45) Date of Patent: Jan. 29, 2002

(54) TWO-IN-ONE COMBINATION SAFE LOCK

(76) Inventor: Yung-Yuan Chen, No. 318, An Ching St., Sanchung City, Taipei Hsien (TW)

( * ) Notice: Subject to any disclaimer, the term of this patent is extended or adjusted under 35 U.S.C. 154(b) by 12 days.

(21) Appl. No.: 09/589,095

(22) Filed: Jun. 8, 2000

(51) Int. Cl.[7] ..... E05B 37/08
(52) U.S. Cl. ..... 70/303 A; 70/279.1; 70/DIG. 63
(58) Field of Search ..... 70/279.1, 303 A, 70/DIG. 63, 284, 285, 278.7

(56) References Cited

U.S. PATENT DOCUMENTS 3,475,932 A * 11/1969 Germanton ..... 70/278
5,540,068 A * 7/1996 Gatner et al. ..... 70/277
5,715,716 A * 2/1998 Miller et al. ..... 70/303 A
5,887,467 A * 3/1999 Butterweck et al. ..... 70/278
6,016,677 A * 1/2000 Clark ..... 70/416
6,098,433 A * 8/2000 Maniaci ..... 70/278.1

* cited by examiner

*Primary Examiner*—Lynne H. Browne
*Assistant Examiner*—John B Walsh
(74) *Attorney, Agent, or Firm*—Bacon & Thomas, PLLC

(57) ABSTRACT

A two-in-one combination safe lock. The combination safe lock includes lock device and an electronic lock device in a box that is set on the side of a safe door with a lock latch on the upper side. A numeric dial and a circular pushbutton plate are disposed at the front side of the safe door and the wheel is connected to the mechanical lock device and the electronic lock device in the box by a shaft. By rotating the numeric dial or inputting the access code through the circular pushbutton plate, the mechanical lock device and the electronic lock device are moved to pull back the lock latch and open the safe door.

2 Claims, 17 Drawing Sheets

TWO-IN-ONE COMBINATION SAFE LOCK

BACKGROUND OF THE INVENTION

I. Field of the Invention

The present invention relates to a two-in-one combination safe lock, especially to the safe lock that includes both a mechanical lock device and an electronic lock device in one box thus the safe door can be open by mechanical or electronic way.

II. Description of the Prior Art

The conventional mechanical combination lock device includes a lock box disposed at the safe door. A shaft inside the box inserts through the safe door with other components thereof. A numeric dial is mounted on one end of the shaft outside the safe door while several numeric plates and a disc are disposed on the other end of the shaft inside the box. And a lock latch that connects to a crank is set at the top of the box. When a numeric dial is turned to-and-fro for inputting the access code, the numeric plates rotates accordingly. If the access code is correct, the crank catches onto the disc so that that the disc drives the crank to lower down the latch and open the safe door once rotates the numeric dial.

The electronic combined lock opens the safe lock by inputting the access code through a circular pushbutton plate to transmit digital signal to the integrated circuit that drives an electromagnetic valve so that a shuttle rod controlled by the electromagnetic valve moves inward and the safe door is open.

Yet the access code inputting must be correct when rotating the numeric dial and the mechanical device otherwise the openings and the groove are not aligned so the safe door can't be opened. The alignment usually does not result in a precise match even though the correct password has been inputted, thus inconveniencing the users.

The electronic lock device has to consume battery power and the power of an electronic lock device will lose power gradually until all of the battery power has been consumed. At this time, the safe door cannot be opened thus becoming an inconvenience to the user.

SUMMARY OF THE INVENTION

It is therefore the primary object of the present invention to provide a two-in-one combination safe lock having a mechanical lock device and an electronic lock device thus the safe door is open either by the mechanical lock or the electronic lock.

The present invention mainly comprises a mechanical lock device and an electronic lock device in a box. A lock latch is disposed at the top side of the box which can moves back and forth through. The mechanical lock device includes a shaft inserting through the box with a numeric dial thereof set outside the safe door. And several numeric plates having an opening respectively as well as a disc are arranged on the other end of the shaft inside the box. Under the lock latch, an electrical crank is set at the same position coaxial to the mechanical crank and both hinges the lower part of the lock latch. At the upper side of the electrical crank a cut is designed. A shuttle device is disposed at the rear of the electrical crank, having a shuttle rod inside a bushing while a spring set in the front end of the shuttle rod makes the trombone-action shuttle rod hooks to the cut of the electrical crank. The shuttle rod is moved in accordance with the movement of the first rod by an electromagnetic valve being controlled by an integrated circuit that connects to a circular pushbutton plate. One end of the second rod is connected to the front end of the shuttle rod while the other end of the second rod connected with the side of the mechanical crank. In accordance with the above structure, the safe door can be open by rotating the numeric dial or input the access code through the circular pushbutton plate to pull back the lock latch by the mechanical lock device or the electronic lock device.

The present invention can be best understood through the following description and accompanying drawings, wherein:

DETAILED DESCRIPTION OF THE PREFERRED EMBODIMENTS

Figure 1:
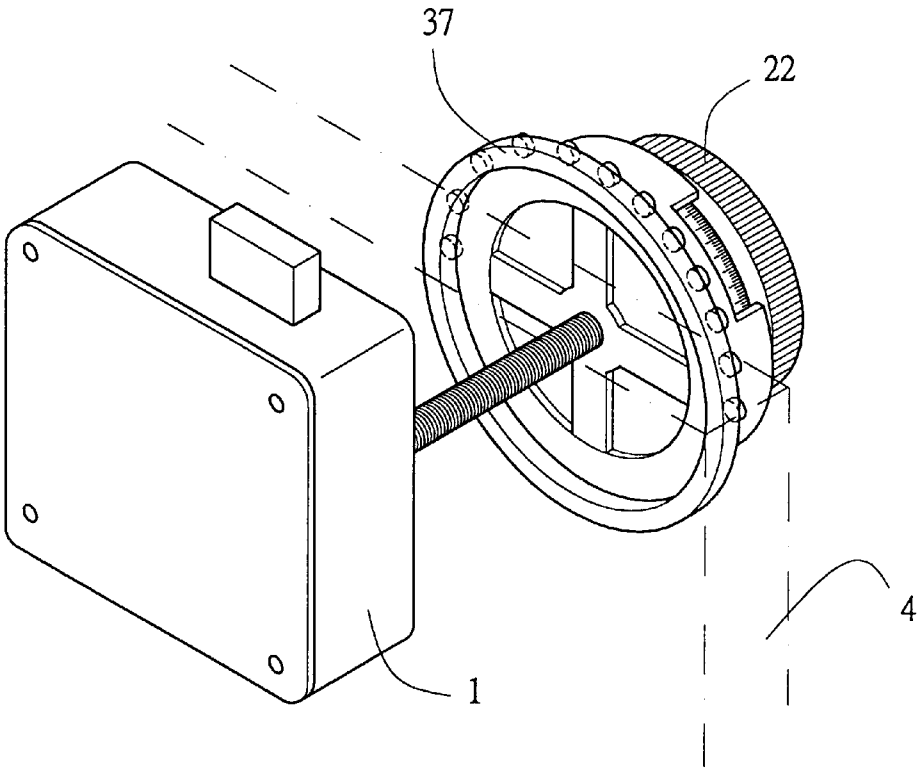
FIG. 1 a schematic diagram of the present invention.
Figure 2:
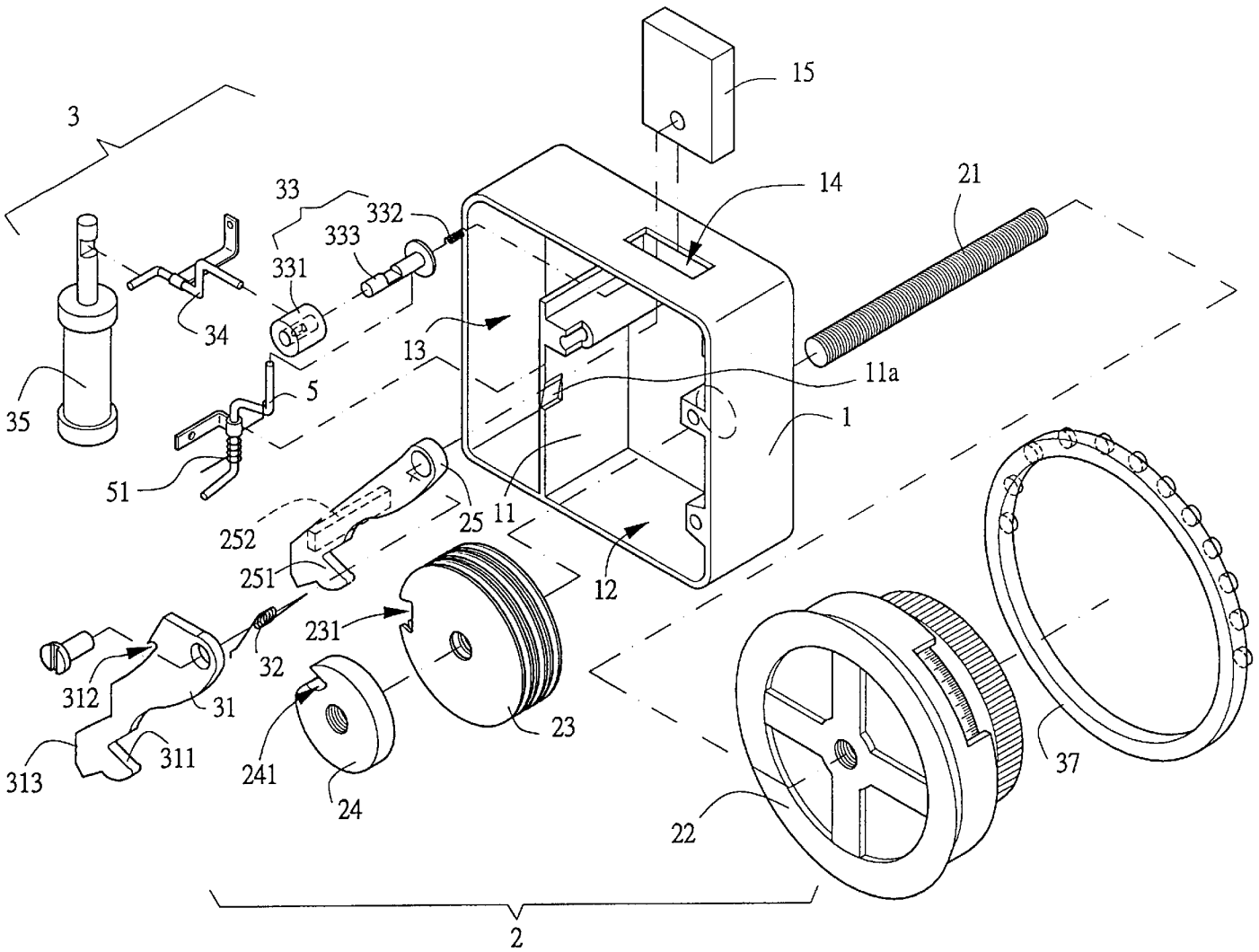
FIG. 2 is an exploded view of the present invention.
Figure 3:
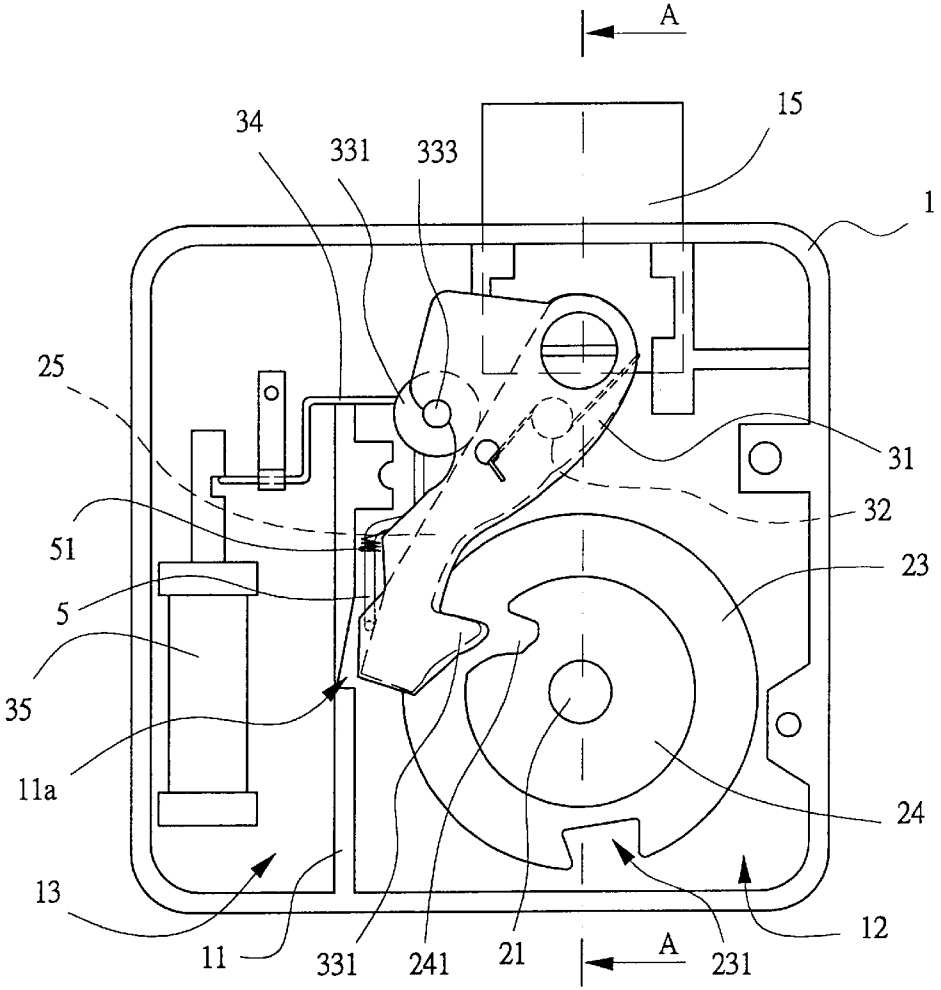
FIG. 3 is a front assembly view of the present invention.
Figure 4:
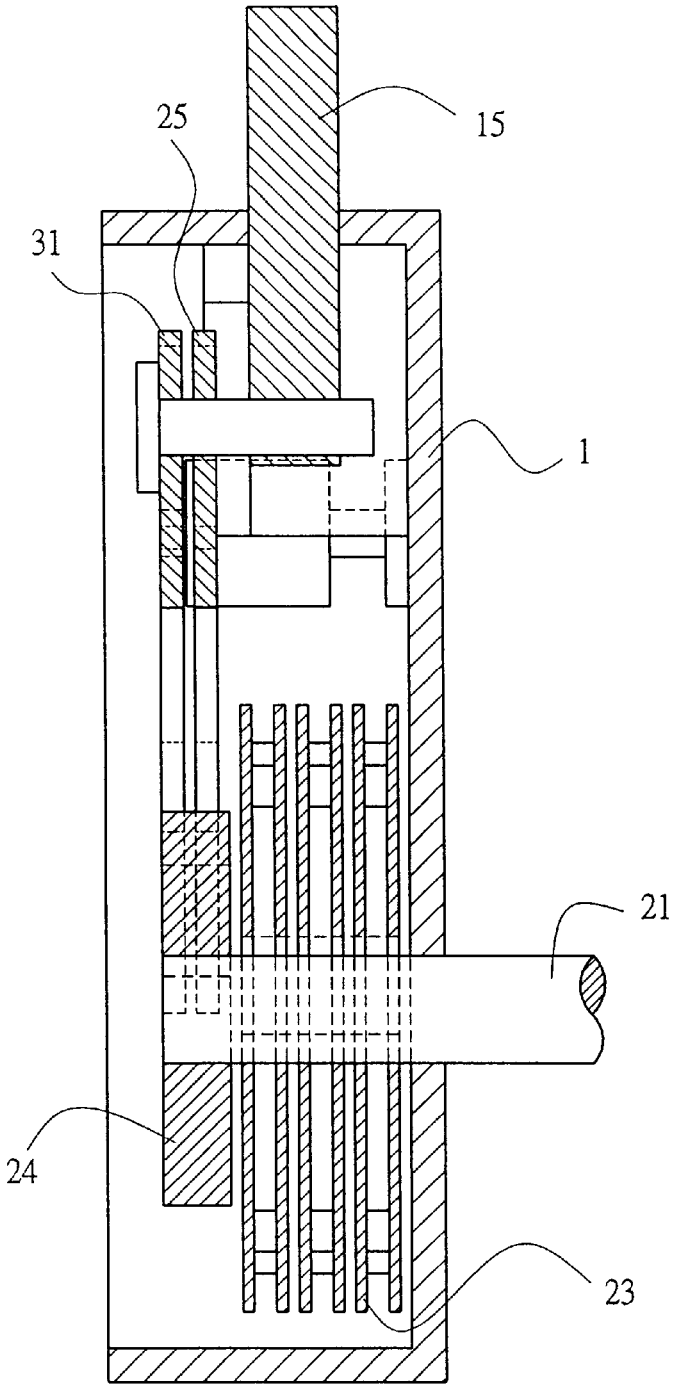
FIG. 4 is a sectional view taken of the lines A—A of FIG. 3.

As shown in FIGS. 1,2,3, and 4, the invention comprises a mechanical lock and an electronic lock in a box 1, which is mounted at the door edge of safes. The box 1 is separated into the first cabin 12 and the second cabin 13 by a lining 11, and a rectangular slot 14 is disposed on the top of the box 1 for accommodating the lock latch 15.

Mechanical lock device 2 includes a shaft 21 on the lower part of the box 1 with other components disposed thereon.

A numeric dial 22 is disposed on one end of the shaft 21 outside the safe door 4 and a disc 24 with a groove 241 is mounted at the other end of the shaft 21. And a number of numeric plates 23 that each has a concave opening 231 on its circle are arranged between the numeric dial 22 and the disc 24 on the shaft 21. Under the lock latch 15 of the box 1, a mechanical crank 25 with a hook 251 on one end hinges to the latch 15 on the box 1. And a stop rod 252 is secured to the lateral side of the mechanical crank 25 along the axile thereof.

Figure 5:
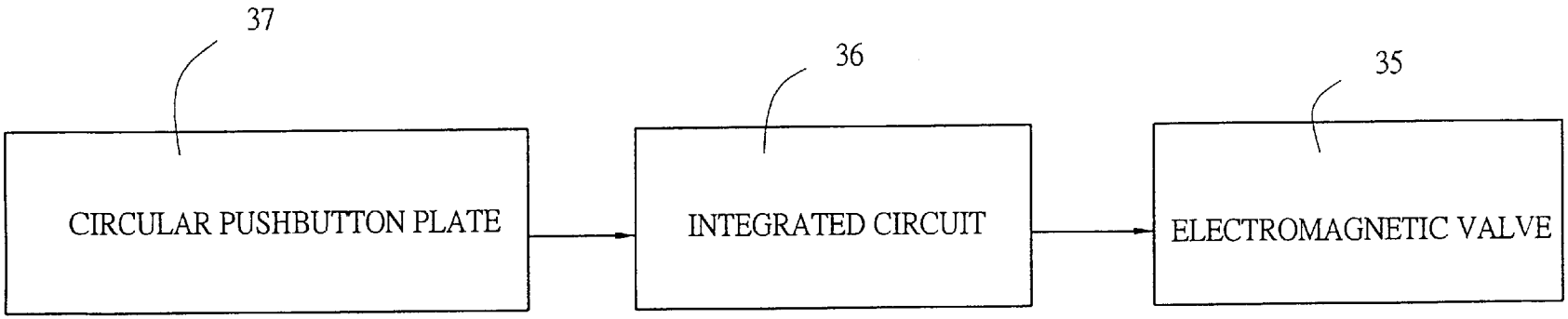
FIG. 5 is a circuit diagram in accordance with the present invention.
Figure 6:
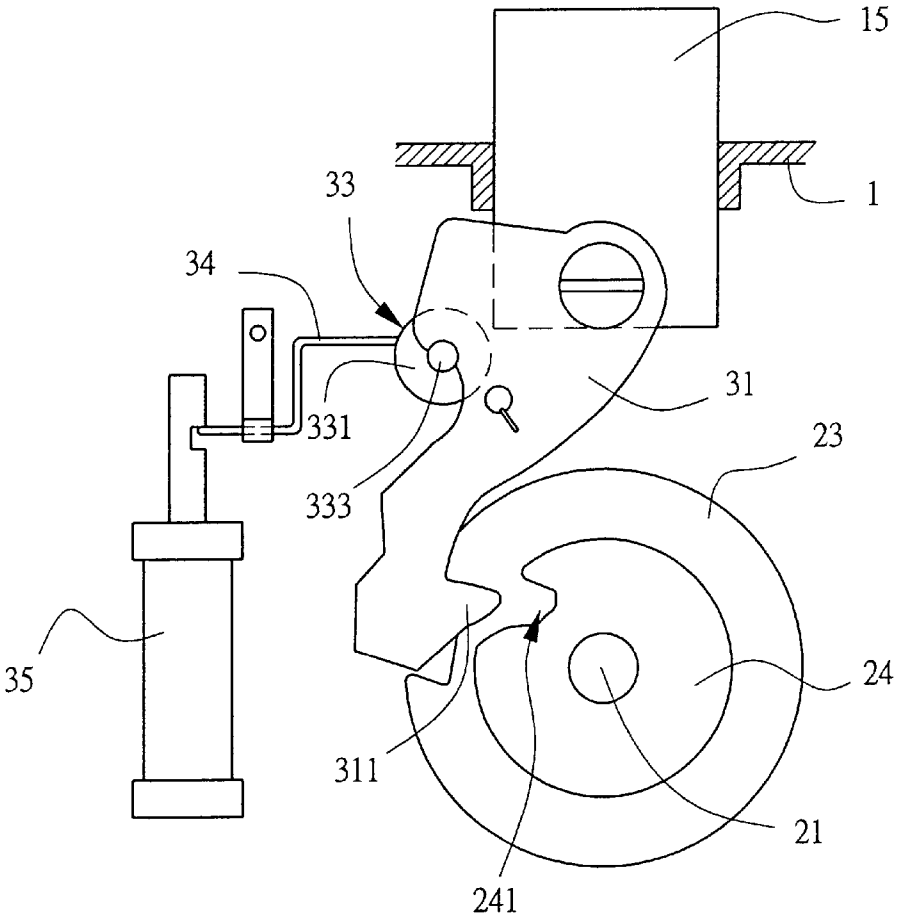
FIG. 6 is a planar partial diagram of the motion procedure of the present invention by using the electrical lock to open the safe door-1.
Figure 7:
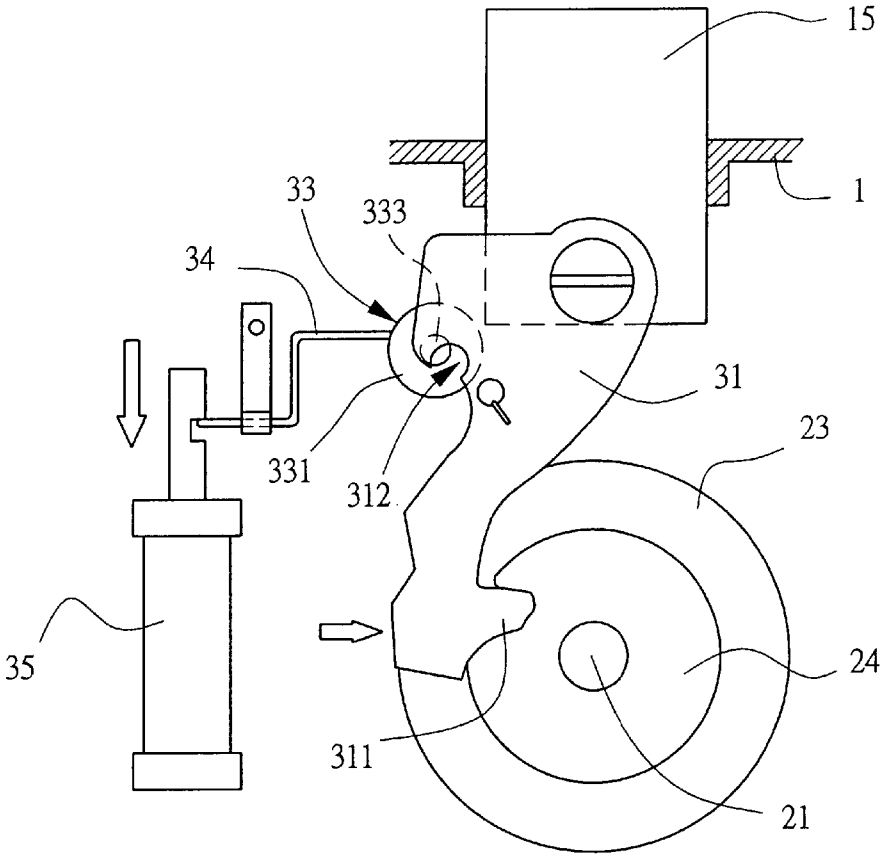
FIG. 7 is a planar partial diagram of the present invention by using the electrical lock to open the safe door-2.
Figure 8:
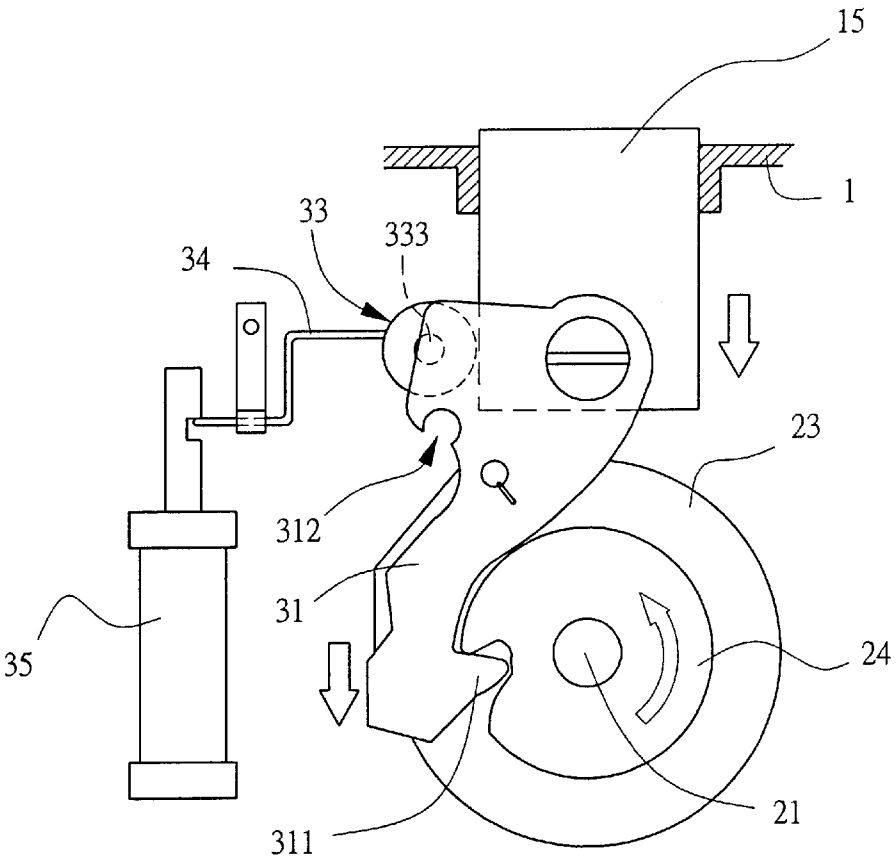
FIG. 8 is a planar partial diagram of the present invention by using the electrical lock to open the safe door-3.
Figure 9:
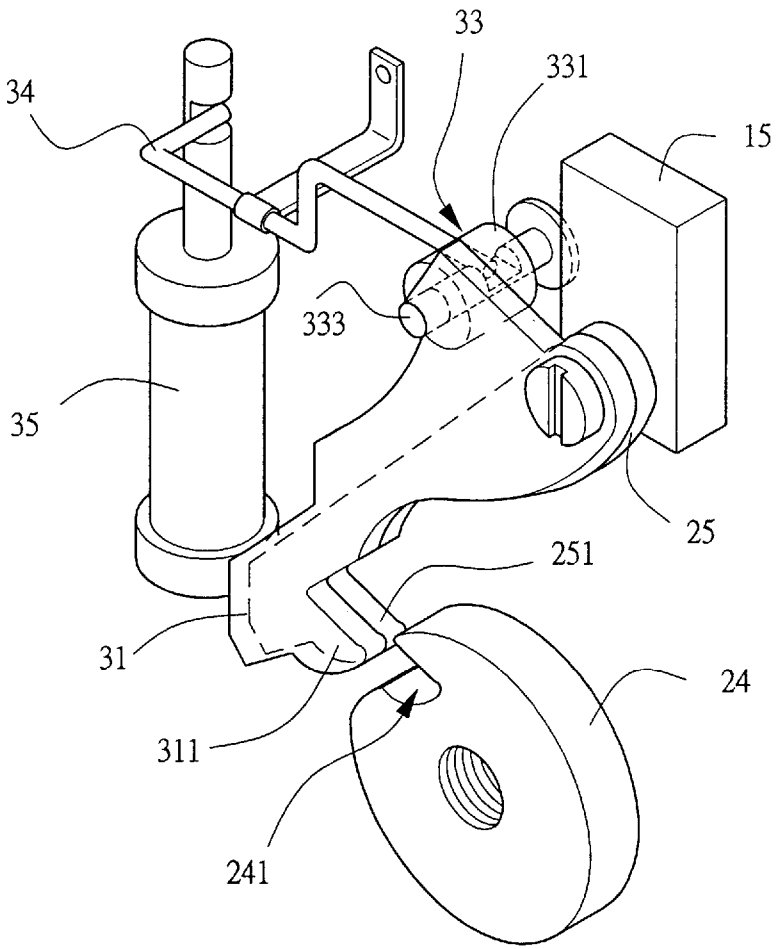
FIG. 9 is a perspective partial diagram of the motion procedure of the present invention by using the electrical lock to open the safe door-1.
Figure 10:
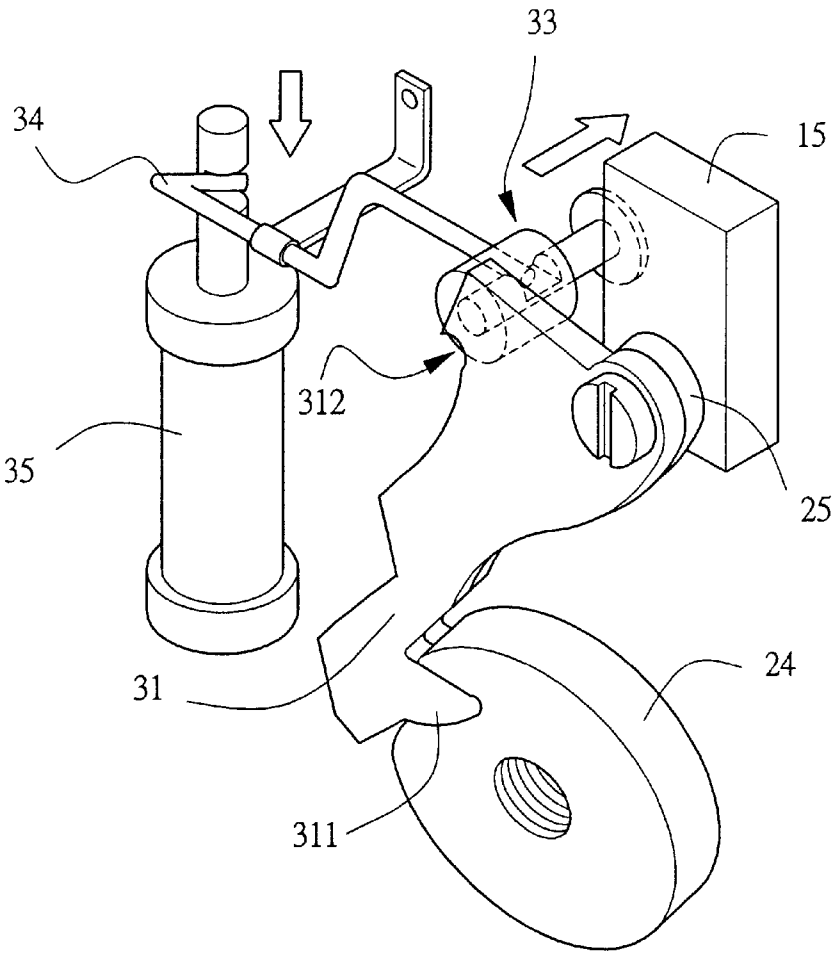
FIG. 10 is a perspective partial diagram of the motion procedure of the present invention by using the electrical lock to open the safe door-2.
Figure 11:
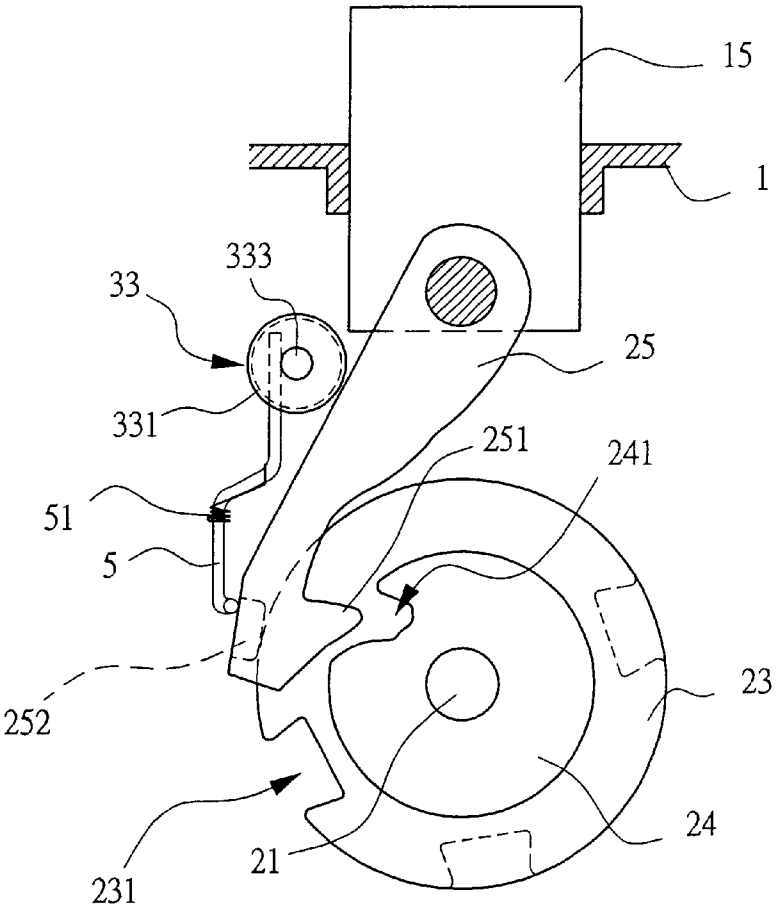
FIG. 11 is a planar partial diagram of the motion procedure of the present invention by using the mechanical lock to open the safe door-1.
Figure 12:
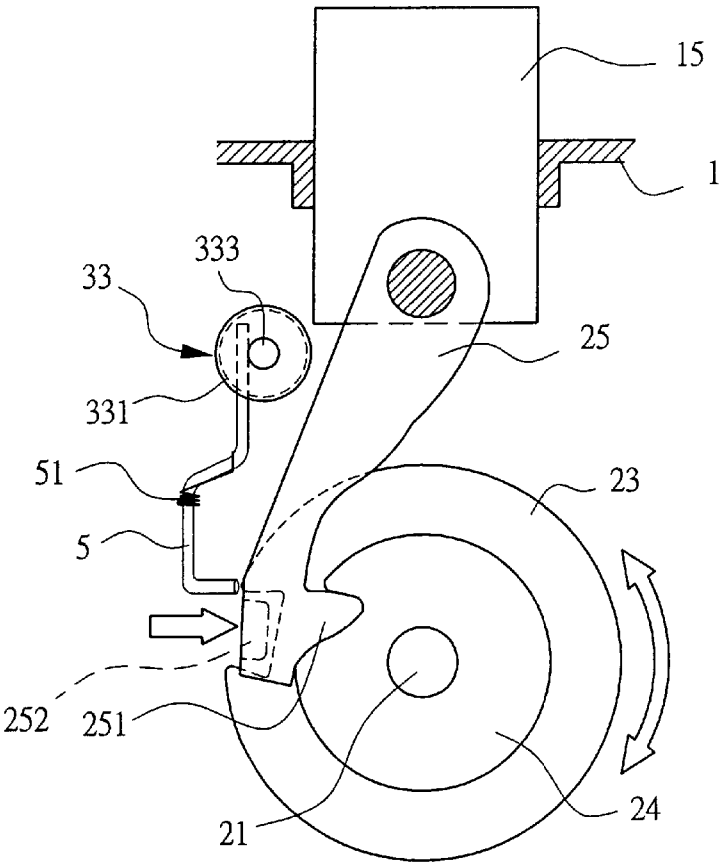
FIG. 12 is a planar partial diagram of the motion procedure of the present invention by using the mechanical lock to open the safe door-2.
Figure 13:
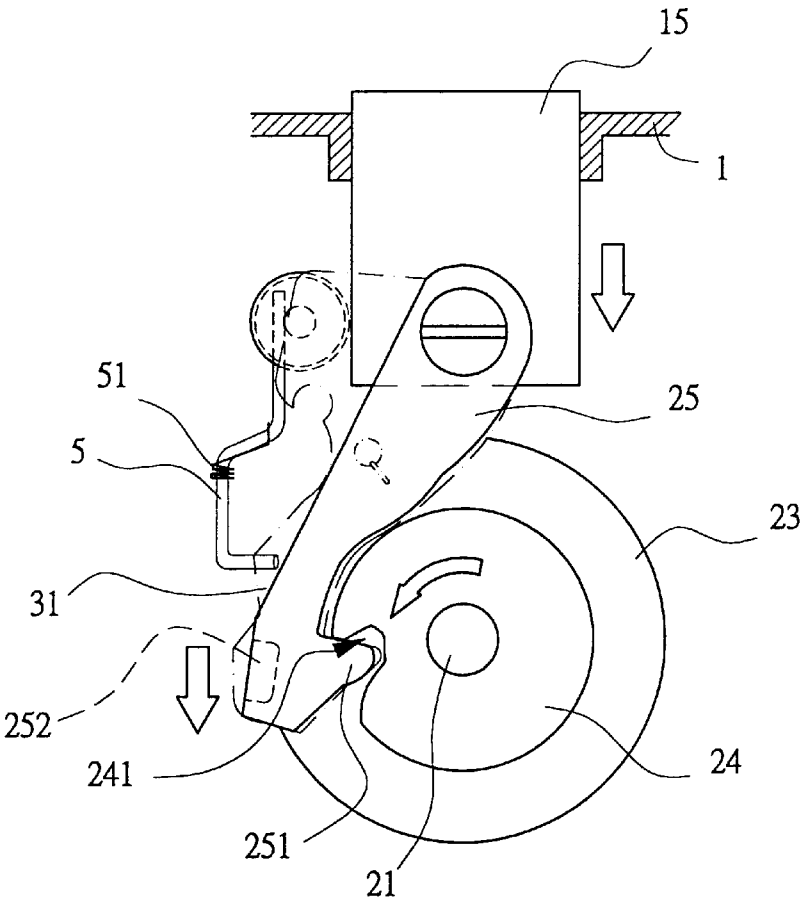
FIG. 13 is a planar patrial diagram of the motion procedure of the present invention by using the mechanical lock to open the safe door-3.
Figure 14:
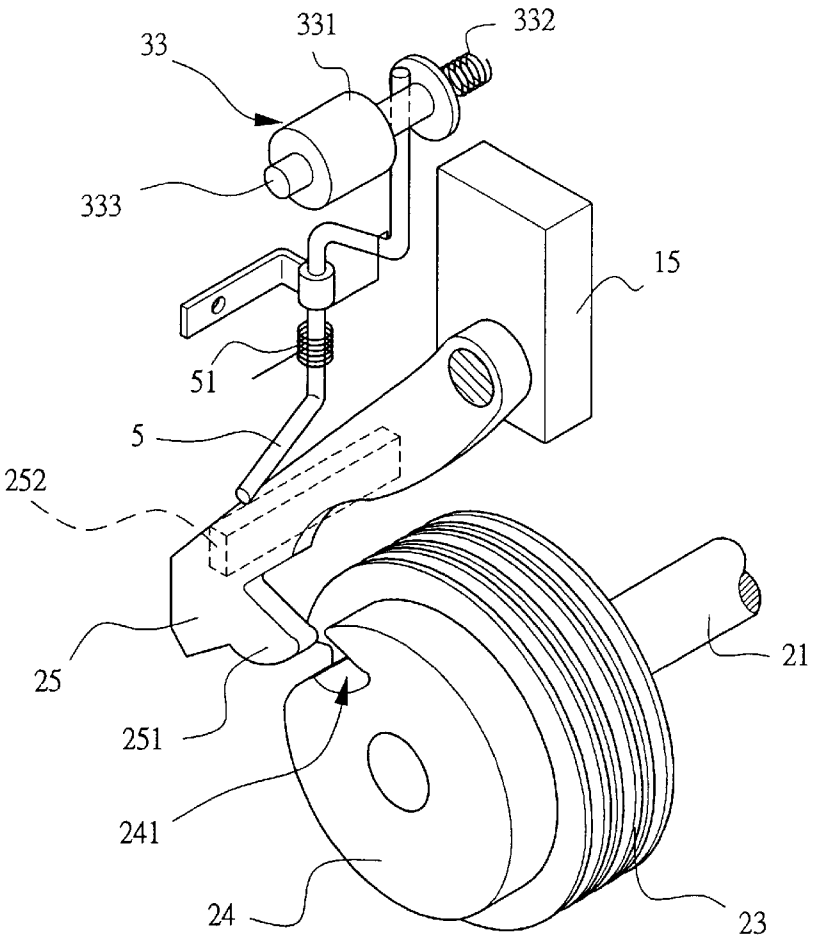
FIG. 14 is a perspective partial diagram of the motion procedure of the present invention by using the mechanical lock to open the safe door-1.
Figure 15:
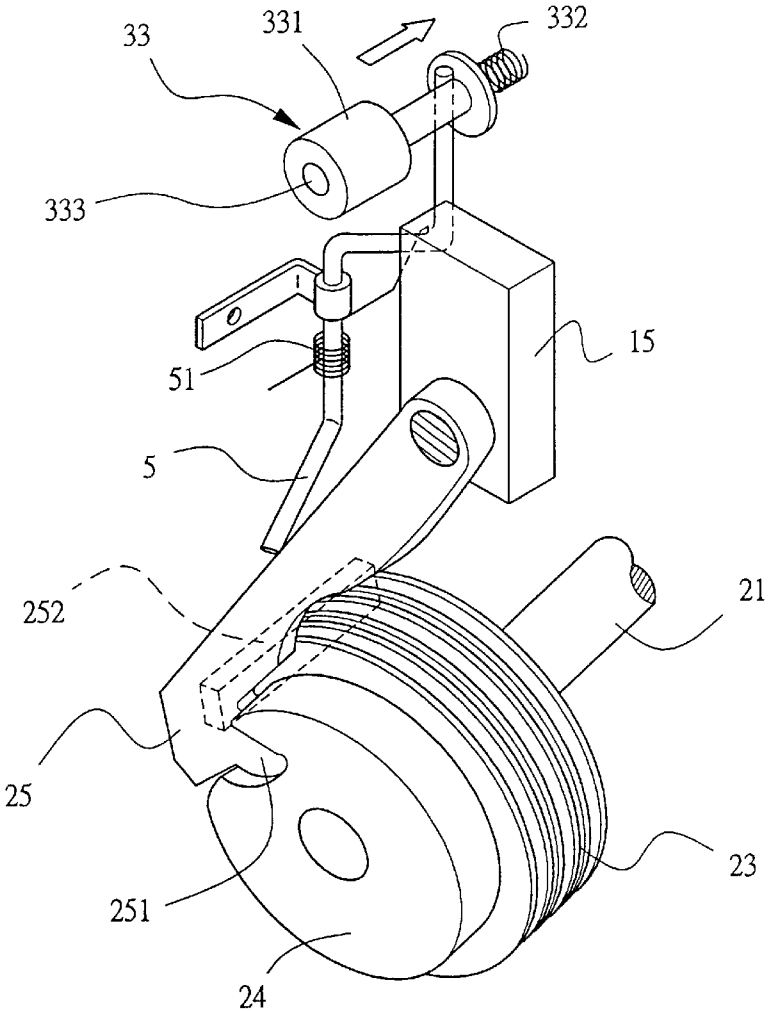
FIG. 15 is a perspective partial diagram of the motion procedure of the present invention by using the mechanical lock to open the safe door-2.
Figure 16:
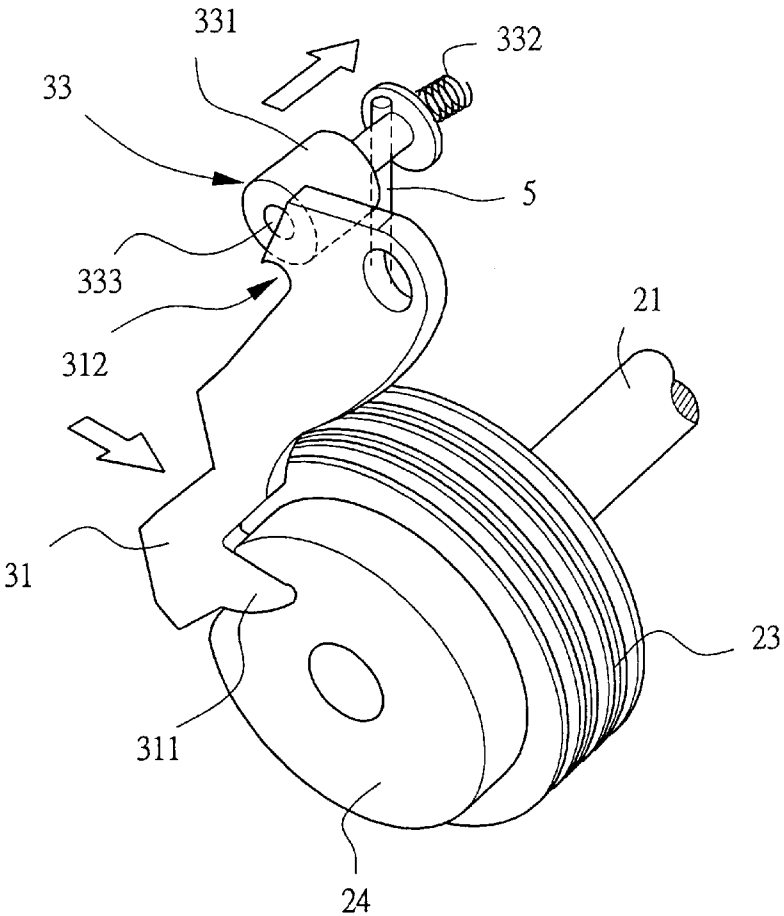
FIG. 16 is a perspective partial diagram of the motion procedure of the present invention by using the mechanical lock to open the safe door-3.

As for electrical lock device 3, under the lock latch 15, an electrical crank 31 with a crook 311 at the lower position hinges to the box coaxial to the mechanical rank 25. A cut 312 is disposed at the upper lateral side of the electrical crank 31 and a torsion spring 32 is set between the mechanical crank 25 and the electrical crank31. A shuttle device 33 is secured to the rear side of the electrical crank 31 in the box 1 while the shuttle device 33 includes a bushing 331 with a trombone-action shuttle rod 333 mounted therein and the front end of the shuttle rod 333 which is controlled by a spring 332 can hook to the cut 312 of the electrical crank 31. One end of the first rod 34 is connected to the middle portion of the shuttle rod 333 and the other end of the first rod 34 is connected to and controlled by an electromagnetic valve 35 located inside the second cabin 13 of the box 1. Refer to FIG.5, the electromagnetic valve 35 is controlled by an integrated circuit 36 which connects to a circular pushbutton plate 37 that is secured at the outer side of the numeric dial 22.

The second rod 5 with a torsion spring 51 is mounted in the first cabin 12 of the box 1. And the torsion spring 51 holding one end of the second connection rod 5 pushes that end of the second connection rod 5 toward the lateral side of the mechanical crank 25, while the other end of the second rod 5 connects with inner side of the shuttle rod 333 of the shuttle device 33. As the mechanical crank 25 works, the second connection rod 5 moves the shuttle rod 333 of shuttle device 33 inwards to release electric crank 31 which makes the crook 311 thereof and the hook 251 of the mechanical crank 25 hitch onto the groove 241 of the disc 24 and causes the mechanical crank 25 and electrical crank 31 of electrical lock device 3 work simultaneously.

With reference to FIG. 6–FIG. 10, if the safe door 4 is open by the electrical lock device 3, an access code is input through the circular pushbutton plate 37 in order to initiate the integrated circuit 36 to trigger the electromagnetic valve 35 that drives the first rod 34 to pull the shuttle rod 333 inwards and push the shuttle rod 333 off the cut 312 of the electrical crank 31. Therefore, the crook 311 of electric crank 31 hooks up to the groove 241 of the disc 24, and then the safe door 4 is open by rolling the numeric dial 22 to pull down the lock latch 15, as shown from FIGS. 6 to 10.

When the safe door 4 is open by using mechanical lock device 2, the numeric dial 22 of mechanical lock device is turned to-and-fro in order to make the openings 231 of each numeric plate 23 of alignment and then the stop rod 252 of the mechanical crank 25 inserts into the opening 231 of the numeric plates 23 so that the hook 251 of the mechanical crank 25 catches onto the groove 241 of the disc 24. Afterwards, the second rod 5 drives the shuttle rod 333 of the shuttle device 33 to move inwards thus the shuttle rod 333 slips from the cut 312 of the electrical crank 31. Due to the torsion spring 32 set between the electrical crank 31 and the mechanical crank 25, the crook 311 of the electrical crank 31 as well as the hook 251 of the mechanical crank 25 hook onto the groove 241 of the disc 24 simultaneously when the electrical crank 31 were released by the shuttle rod 333, as shown from FIG. 11 to FIG. 16. Therefore, the safe door is open by rotating the numeric dial 22 that makes the mechanical crank 25 and the electrical crank 31 work concurrently to pull down the latch 15.

For opening the safe door 4, users can choose to rotate the numeric dial 22 of the mechanical lock device 2 or input the access code either by the circular pushbutton plate 37 of the electrical lock device 3. If the mechanical lock device 2 malfunctions, the electrical lock device 3 can be used to open the safe door 4. On the other hand, if the battery power of the electrical lock device 3 has run out, the mechanical lock device 2 can be selected to open the safe door 4. Hence the chances of not being able to open the safe door can be reduced if one of the lock devices (electrical or mechanical) malfunctions.

Figure 17:
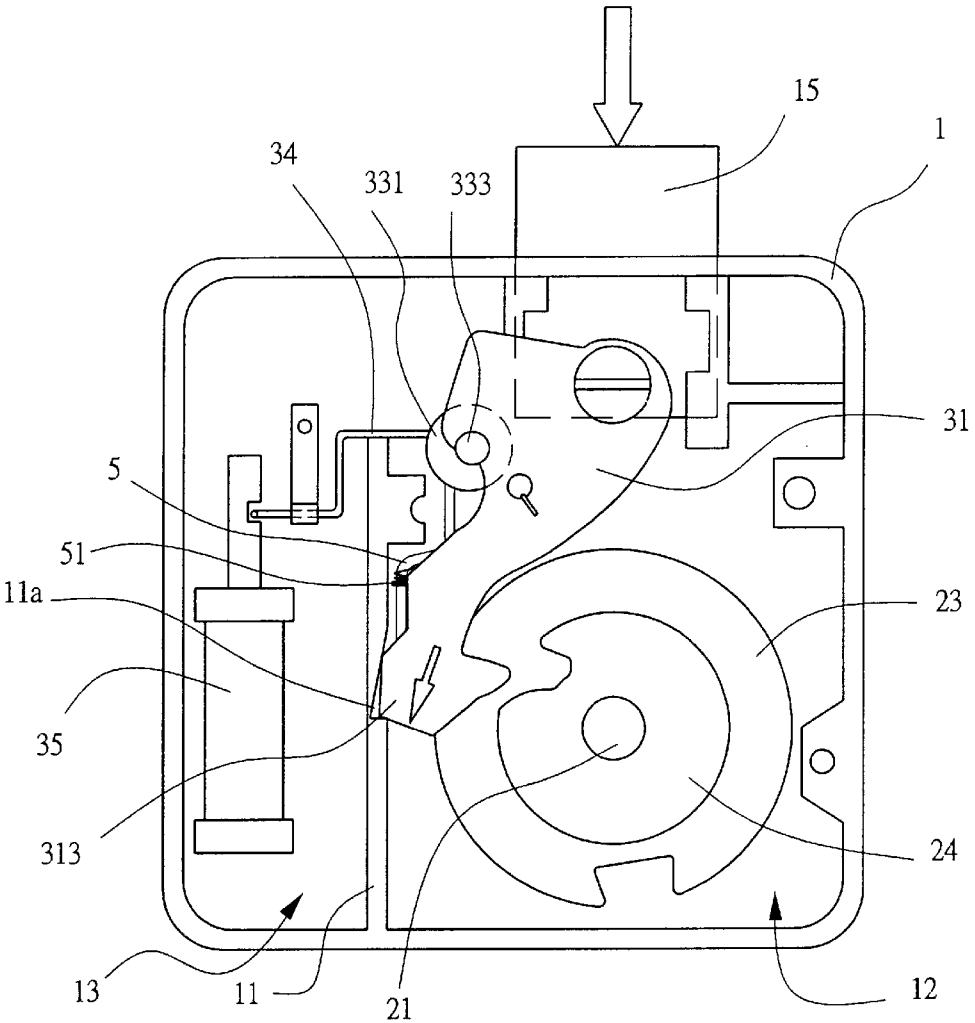
FIG. 17 is a planar partial diagram of the present invention to avoid destruction.

Please refer to FIG. 17, a cavity 11*a* is disposed on the side of the lining 11 toward the first cabin 11 of the box 1. A stop edge 313 is mounted on the lower part of the above mentioned electronic crank 31. If the safe were broken by burglars using tools to push the latch 15 downward, the stop edge 313 of the electrical crank 31 is held on the cavity 11*a* so that the latch 15 can't be pushed and the safe door can not be open by this way.

What is claimed is:

1. A two-in-one combination safe lock comprising a mechanical lock device and an electronic lock device in a box, wherein:

said box is mounted at a door edge of a safe and is separated into a first cabin and a second cabin by a lining; a rectangular slot is disposed on a top of said box for accommodating a lock latch that moves up and down;

the mechanical lock device includes a shaft inserted through the first cabin of the box and a numeric dial is disposed on one end of said shaft outside a door of the safe and a disc with a groove is mounted at the other end of said shaft; and a number of numeric plates that each has an opening are arranged between said numeric dial and said disc on said shaft; a mechanical crank with a hook on a lower part thereof and a stop rod on a lateral side thereof hinges to a lower part of said latch on said box; by turning a turning wheel connected to said shaft, said shaft is rotated and said openings of said numeric plates are aligned and then said stop rod of said mechanical crank inserts into said openings of said numeric plates so that said hook of said mechanical crank catches onto said groove of said disc; said latch moves downward through movement of said mechanical crank when said numeric dial is rotated;

the electronic lock device includes an electrical crank which hinges to the lower part of said latch on said box coaxial to said mechanical crank; a crook is set on one end of said electrical crank and a cut is mounted on the lateral side of said electrical crank; a torsion spring is set between said mechanical crank and said electrical crank; a shuttle device, which includes a shuttle rod at one end is inside a bushing and a spring in the other end of said shuttle rod, is disposed at the rear of said electrical crank; the front end of said shuttle rod is connected to said cut of said electrical crank and a middle part of said shuttle rod is connected to a first rod; said shuttle rod is moved in accordance with the movement of said first rod controlled by an electromagnetic valve that is controlled by an integrated circuit that connects to a circular pushbutton plate; said circular pushbutton plate is mounted outside said numeric dial on said safe door; an access code is input through said circular pushbutton plate to make said integrated circuit trigger said electromagnetic valve so that said first rod is moved by said electromagnetic valve and said shuttle rod is pulled off said cut of said electrical crank by said first rod; said crook of said electrical crank catches on said groove of said disc so that said latch is moved downwards by rotating said numeric dial; and a second rod is disposed inside said first cabin with a torsion spring thereon connected to the lateral side of said mechanical crank while the other end of said second rod is connected with said shuttle rod; said mechanical crank drives said shuttle rod to move inwards to release said electrical crank whereby said crook of said electrical crank and said hook of said mechanical crank both catches onto said groove of said disc; and said electrical crank of said electrical lock device works with said mechanical crank simultaneously when said mechanical lock device operates.

2. The two-in-one combination safe lock as claimed in claim 1, wherein a cavity is disposed on the side of said lining towards said first cabin of said box and the lateral side of said electrical crank hooks to said cavity for preventing said latch from being pushed downward.

* * * * *